US005502974A

United States Patent [19]

Zugibe

[11] Patent Number: 5,502,974

[45] Date of Patent: Apr. 2, 1996

[54] HYDRAULIC SYSTEM FOR RECOVERING REFRIGERANTS

[75] Inventor: Kevin J. Zugibe, Haverstraw, N.Y.

[73] Assignee: Hudson Technologies, Inc., Hillburn, N.Y.

[21] Appl. No.: 299,523

[22] Filed: Sep. 1, 1994

[51] Int. Cl.[6] ..... F25B 45/00

[52] U.S. Cl. ..... 62/77; 62/292; 417/393

[58] Field of Search ..... 62/323.1, DIG. 2, 62/292, 77; 417/393, 401, 63; 91/316, 329

[56] References Cited

U.S. PATENT DOCUMENTS

| | | | |
|---|---|---|---|
| 2,899,941 | 8/1959 | Adams | 26/323.1 |
| 2,986,907 | 6/1961 | Hoop | 417/393 |
| 4,381,180 | 4/1983 | Sell | 417/393 |
| 5,020,331 | 6/1991 | Michny | 62/292 |
| 5,170,632 | 12/1992 | Reilly | 62/292 |
| 5,282,366 | 2/1994 | Reilly | 62/292 |

*Primary Examiner*—John M. Sollecito
*Attorney, Agent, or Firm*—Stanley J. Yavner

[57] ABSTRACT

A hydraulic refrigerant recovery system and method moves refrigerant liquid or refrigerant vapor. Substantial pressure is developed by the hydraulic unit for moving a substantially larger piston to increase the pumping rate for refrigerant. Only the size of the inlet line for the hydraulic unit limits the pumping capacity, unlike the capability experienced previously with pneumatic motion for refrigerant liquids. The invention system includes a hydraulic pump, oil reservoir, a hydraulic cylinder, a spool valve and a limit switch assembly.

8 Claims, 1 Drawing Sheet

HYDRAULIC SYSTEM FOR RECOVERING REFRIGERANTS

FIELD OF THE INVENTION

This invention relates primarily to refrigerant reclamation systems and more particularly to such systems, and a method for use thereof, which includes hydraulic apparatus for moving a refrigerant liquid or vapor.

BACKGROUND OF THE INVENTION

Normally, pneumatic systems are provided to move refrigerant for purposes such as recovery thereof. In such pneumatic systems, both a liquid and vapor refrigerant is moved for purposes of recovery thereof. However, it has been found that a major limiting factor for the pneumatic system is the maximum attainable air pressure, which is in the range of one hundred seventy five pounds per square inch.

In hydraulic technology used for various purposes, it is common to develop as much as three thousand pounds per square inch in order to move a much larger piston, than was and is the case with pneumatic technology. Transmitting such factors to a system for pumping liquid refrigerant, it is the result that large pneumatic systems claim a pumping rate of thirty pounds per minute for such refrigerant liquid.

With hydraulic technology, however, upwards of four hundred pounds per minute of liquid refrigerant is achieved, with the only limiting factor being the size of the inlet line. Furthermore, speed limitations imposed upon pneumatic systems are not a major concern with hydraulic technology.

OBJECTS AND SUMMARY OF THE INVENTION

Accordingly, a primary object of the present invention is to make use of hydraulic technology in a system for moving liquid or vapor refrigerant.

A further, and more particular object of the present invention is to provide a hydraulic system and method for moving liquid or vapor refrigerant with a high pump rate by moving a larger piston and operating with larger speed of movement than previously possible with a pneumatic unit.

These and other objects of the present invention are provided with apparatus in a system, and using that system in a method, for moving large amounts of refrigerant for recovery or reclamation in a shorter time period than with previously available pneumatic technology. The hydraulic system and apparatus comprise a hydraulic pump, an oil reservoir for operating the pump, a hydraulic cylinder, whose motion is controlled by a remote switch sensing the position of the piston therein, and a spool valve for controlling the flow of hydraulic oil. The hydraulic system supplies control oil from the oil reservoir through a variable flow hydraulic pump, which oil is used to drive the hydraulic cylinder as directed by the spool valve and remote switch assembly. The hydraulic cylinder includes the refrigerant pump pistons which move from a first side to a second side, and at this time vapor and/or liquid refrigerant is drawn in the first side from a first inlet through a first check valve, as a second check valve is held shut by back pressure. The second side of the refrigerant piston pump is discharging vapor and/or liquid refrigerant to a regulating outlet valve through a fourth check valve, while the third check valve on the second side of the refrigerant pump pistons is held shut by inner cylinder pressure. At the end of the stroke, the remote switch assembly reverses the hydraulic oil flow through the spool valve and thereby drives the refrigerant pump pistons in the opposite direction. The process is reversed from the second side to the first side.

At this time, vapor and/or liquid refrigerant is drawn into the second side of the refrigerant pump from the first inlet through the third check valve, as the fourth check valve is held shut by means of downstream pressure. The first side of the piston pump is now discharging vapor and/or liquid refrigerant to an outlet regulating valve, through the second check valve. The first check valve is held shut by inner cylinder pressure.

At all times, the hydraulic oil from the retracting side of the power hydraulic cylinder is returning oil to the hydraulic reservoir through the hydraulic spool valve.

The limit switch assembly controls the direction of the hydraulic oil according to its sensing of the piston position. At the end of each stroke, the limit switch assembly reverses the direction of the refrigerant pump piston.

BRIEF DESCRIPTION OF THE DRAWINGS

Other objects, features and advantages of the present invention will become apparant by reference to the following description of a preferred, but nonetheless illustrative, embodiment, with reference to the accompanying drawing, wherein.

DETAILED DESCRIPTION OF THE PREFERRED EMBODIMENT

Figure 1:
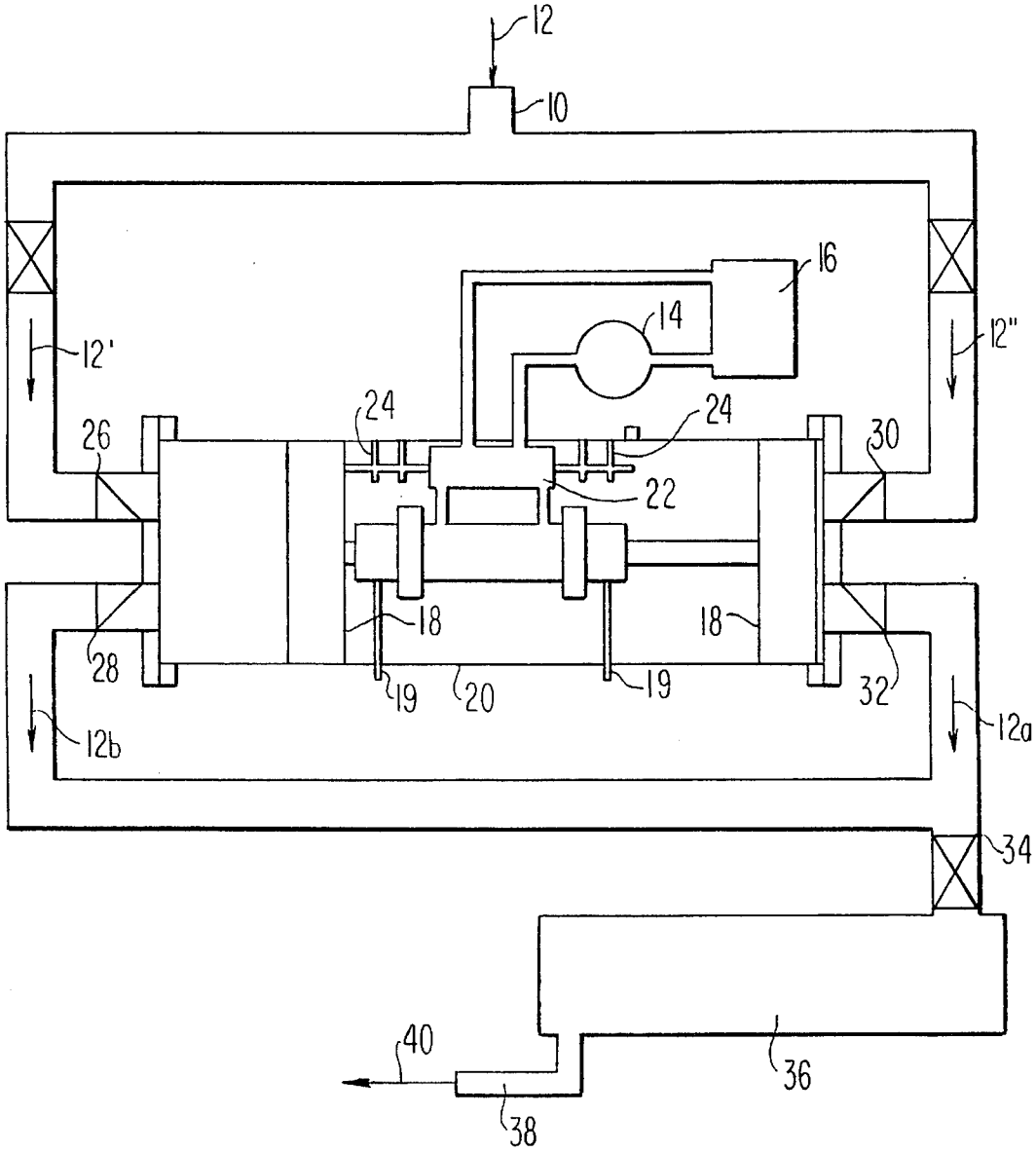
FIG. 1 shows a schematic representation of a system method and apparatus according to the present invention.

The drawing of the invention illustrates schematically the various elements and interrelationships thereof of the present invention, showing elements of a hydraulic system for driving a piston in a hydraulic cylinder in order to move refrigerant liquid or vapor for purposes of reclamation or recovery. The elements include an inlet port 10 for admitting refrigerant in a direction depicted by arrow 12, a hydraulic pump 14, a hydraulic oil reservoir 16, the pump 14 controlling the flow of oil from oil reservoir 16. Pump 14 is of the variable flow hydraulic type.

The hydraulic oil is used to drive a hydraulic piston 18 in a hydraulic cylinder 20, and cylinder 20 is connected to spool valve 22, which controls the flow of hydraulic oil to and from hydraulic reservoir 16. Drain lines 19 are also provided.

A limit switch assembly 24 is used to sense the position of piston 18, so that at the end of each stroke the direction of the piston is reversed.

A series of check valves control the flow of refrigerant through the system. First check valve 26 controls the flow of vapor refrigerant and/or liquid refrigerant from inlet 10 in a direction depicted by arrow 12' at the left or first side of the system in the orientation of the drawing. In the nomenclature of this application and/or patent, the motion of piston 18 from the left side to the right side shall be considered a first direction; and the motion of the piston from the right side to the left side, or from the second side to the first side, shall be considered a second direction.

A second check valve 28 is located on the first side of the system, whereas the second side of the piston and cylinder includes third and fourth check valves 30, 32. Regulating outlet valve 34 is located to enable refrigerant to flow in a controlled manner through condenser 36 to a condensed refrigerant outlet 38, for enabling outlet flow in a direction decpited by arrow 40.

Thus, in operation of the system, the operation begins with motion of the piston from the left side to the right side, or from a first side to a second side. At this time, refrigerant vapor and/or liquid refrigerant is drawn in through inlet 10, in direction 12', and through check valve 26, as check valve 28 is held shut by back pressure. The right or second side of the refrigerant piston is discharging vapor and/or liquid refrigerant to regulating valve 34, through check valve 32, in a direction depicted by arrow 12*a*, while check valve 30 is held shut by inner cylinder pressure.

At the end of that stroke of piston 18, the limit switch assembly 24 reverses hydraulic oil through spool valve 22 to drive the refrigerant piston in the opposite direction, so that refrigerant liquid or vapor is drawn into the right or the second side of the refrigerant piston 18 from inlet 10 in a direction depicted by arrow 12" through check valve 30, as check valve 32 is held shut due to downstream pressure. The left or first side of the refrigerant piston pump is now discharging vapor and/or liquid refrigerant in a direction depicted by arrow 12*b* to regulating valve 34 through check valve 28. Check valve 26 is held shut by inner cylinder pressure.

At all times, the hydraulic oil from the retracting side of hydraulic cylinder 20 is returning oil to the hydraulic reservoir 16 through hydraulic spool valve 22.

The limit switch assembly 24 controls the direction of the hydraulic oil, according to its sensing of the piston position; and at the end of each stroke the limit switch assembly 24 reverses the direction of the refrigerant pump.

In this manner, a method for reclaiming, recovering or otherwise treating refrigerant liquid and/or vapor is provided in connection with an air or water-cooled condenser step, through a condensed refrigerant outlet 38 in a direction depicted by arrow 40.

While operation of the various elements of the system apparatus has been described, and thereby the steps of the method taught, the limits of the present invention method and system are to be imposed only by the following claims:

What is claimed is:

1. A hydraulic system for moving refrigerant to recover said refrigerant and for controlling such movement by means of a hydraulic refrigerant recovery pump and a hydraulic oil reservoir comprising a hydraulically controlled cylinder including a hydraulically controlled piston for motion therein in a first direction and in a second direction, a remote limit switch for sensing whether or not said piston has reached the limit of its motion within said cylinder, and for reversing said direction upon recognizing a limit of motion in either of said directions, inlet means for admitting refrigerant to said system to recover refrigerant from a container, an inlet check valve for receiving said refrigerant when said piston begins its motion, an outlet check valve for removing refrigerant from said cylinder and a pair of other check valves for shutting during motion of said piston and a spool valve for further controlling the motion of said hydraulic oil.

2. The invention according to claim 1 wherein a further processing means for said refrigerant, connected to said outlet check valve is provided.

3. The invention according to claim 2, wherein said further processing means comprises a condenser.

4. The invention according to claim 3, wherein said condenser is an air-cooled condenser.

5. The invention according to claim 3, wherein said condenser is a water-cooled condenser.

6. The invention according to claim 3, wherein a regulating valve is provided between said outlet check valve and said condenser.

7. A method for processing and moving refrigerant for recovering said refrigerant is provided and includes the steps of recovering refrigerant from a refrigerant container by:

(a) causing said refrigerant to enter a hydraulic cylinder at a first side of said cylinder;

(b) causing a piston in said cylinder to move from said first side toward a second side of said cylinder;

(c) causing said refrigerant to be removed from said cylinder at said second side;

(d) sensing the limit of motion of said piston from said first side to said second side;

(e) reversing the motion of said piston based upon said sensing; and (f) thereby causing said refrigerant to enter said cylinder at said second side of said cylinder, and removing said refrigerant from said cylinder at said first side for further processing.

8. The invention according to claim 7, wherein said further processing includes a condensing step.

* * * * *